US010590614B2

(12) United States Patent
Hogg et al.

(10) Patent No.: US 10,590,614 B2
(45) Date of Patent: Mar. 17, 2020

(54) SYSTEM AND METHOD

(71) Applicant: REJUVETECH LTD, Sheffield (GB)

(72) Inventors: David Hogg, Sheffield South Yorkshire (GB); Susan Hogg, Sheffield (GB)

(73) Assignee: Rejuvetech Ltd., South Yorkshire (GB)

( * ) Notice: Subject to any disclaimer, the term of this patent is extended or adjusted under 35 U.S.C. 154(b) by 0 days.

(21) Appl. No.: 16/079,467

(22) PCT Filed: Feb. 24, 2017

(86) PCT No.: PCT/GB2017/050495

§ 371 (c)(1),
(2) Date: Aug. 23, 2018

(87) PCT Pub. No.: WO2017/144906

PCT Pub. Date: Aug. 31, 2017

(65) Prior Publication Data

US 2019/0063012 A1 Feb. 28, 2019

(30) Foreign Application Priority Data

Feb. 25, 2016 (GB) ..... 1603249.2

(51) Int. Cl.

| | |
|---|---|
| ***E01C 11/00*** | (2006.01) |
| ***E01C 23/14*** | (2006.01) |
| ***E01C 23/06*** | (2006.01) |

(52) U.S. Cl.

CPC ..... *E01C 23/14* (2013.01); *E01C 11/005* (2013.01); *E01C 23/06* (2013.01)

(58) Field of Classification Search

CPC ..... E01C 11/005; E01C 23/06; E01C 23/14
USPC ..... 404/77, 79, 95
See application file for complete search history.

(56) References Cited

U.S. PATENT DOCUMENTS

| | | | | |
|---|---|---|---|---|
| 3,801,212 | A | 4/1974 | Cutler | |
| 4,601,605 | A | 7/1986 | Damp et al. | |
| 5,791,814 | A * | 8/1998 | Wiley | E01C 23/065 404/103 |
| 6,065,963 | A | 5/2000 | Dewaegheneire et al. | |
| 2003/0134247 | A1 | 7/2003 | Dewaegheneire | |
| 2003/0213485 | A1 | 11/2003 | Kieswetter | |
| 2004/0018774 | A1 | 1/2004 | Long et al. | |
| 2004/0076917 | A1 | 4/2004 | Kieswetter | |
| 2010/0089584 | A1* | 4/2010 | Burns | E21B 43/2401 166/302 |

FOREIGN PATENT DOCUMENTS

| | | |
|---|---|---|
| CN | 1285378 A | 3/2003 |
| GB | 412899 | 7/1934 |
| GB | 1281190 | 7/1972 |
| GB | 2199874 A | 7/1988 |
| GB | 2344369 A | 7/2000 |
| GB | 2418444 | 3/2006 |
| GR | 980100249 A | 9/2000 |

(Continued)

*Primary Examiner* — Raymond W Addie
(74) *Attorney, Agent, or Firm* — Brinks Gilson & Lione

(57) ABSTRACT

An asphalt heater system includes a source of a flow of inert gas, a heater for heating the flow of inert gas and means for directing the flow of heated inert gas to the asphalt surface, wherein the means for directing the flow of heated inert gas to the asphalt surface is a lance. Such systems are suitable for use in methods for repairing defects in an asphalt surface.

19 Claims, 9 Drawing Sheets

(56) References Cited

FOREIGN PATENT DOCUMENTS

| | | | |
|---|---|---|---|
| GR | 1007596 | | 5/2012 |
| JP | 8-13414 | A | 1/1996 |
| RU | 2418128 | C1 | 5/2011 |
| WO | WO 02/099173 | A1 | 12/2001 |
| WO | WO 2006/008187 | A1 | 1/2006 |

* cited by examiner

Defect Before Repair

Defect During Repair

Defect After Repair

Asphalt Surface Before Repair

Asphalt Surface After Repair

SYSTEM AND METHOD

RELATED APPLICATIONS

This application claims the benefit under 35 U.S.C. § 371 of the filing date of International Patent Application PCT/GB2017/050495, having an international filing date of Feb. 24, 2017, which claims the benefit of and priority to Great Britain Patent Application GB 1603249.2, filed on Feb. 25, 2016, both of which are incorporated by reference herein in their entirety.

BACKGROUND

Damage to the asphalt of a road surface can occur through oxidation of the asphalt surface, repeated impaction by vehicular traffic and/or adverse weather conditions.

There are a number of different systems and methods currently used to repair defects, such as potholes, in an asphalt surface. The procedure providing the most durable repair that is currently available involves providing a "clean" edge to the defect, for example by saw cutting around the damaged area, in order to provide vertical edges to the defect. Loose debris is then removed from the defect area, after which a bond material is applied to the base and the sides of the hole. An asphalt filler material (typically a "hot-mix" material) is introduced to the hole and is then compacted and allowed to cool.

However, despite being the most durable repair, the seam between the old asphalt and the new asphalt is a weak point within the repair, which leads to the new asphalt filler material separating from the old asphalt over time. As such, the lifetime of such a repair is typically no longer than 2 to 3 years, after which the defect reappears and the surface requires repairing once more.

According to the Annual Local Authority Road Maintenance Survey 2015 by the Asphalt Industry Alliance, around 2,670,350 potholes were repaired in the UK during 2014 at a total cost of £144.3 million.

It is estimated that it will take around 13 years and cost in the region of £12.1 billion to repair the current backlog of potholes in roads in the UK alone.

However, this estimate is for repairing current potholes and does not take into account the re-occurrence of the potholes due to the limited lifetime of pothole repairs. Therefore, due to the reoccurrence of potholes after such a short time-span, the costs of repairing the roads will increase substantially.

UK application number GB 2418444 describes a road heater system for use in the repair of roads using a Hot-In-Place Recycling technique. The system heats the surface of the road area comprising a defect with an infrared heat source, after which new asphalt filler material is added and the filler material is compacted.

However, the applicants have found that a large amount of oxidation occurs within the asphalt surface when using such a system resulting in a weak and brittle asphalt surface, which in turns lead to the rapid reoccurrence of the pothole defect.

The listing or discussion of an apparently prior-published document in this specification should not necessarily be taken as an acknowledgement that the document is part of the state of the art or is common general knowledge.

The present invention provides an improved system and method for repairing defects in an asphalt surface. The system of the invention may also be used for other processes requiring the heating of an asphalt surface.

According to the present invention, there is provided an asphalt heater system, comprising a source of a flow of inert gas, a heater for heating the flow of inert gas and means for directing the flow of heated inert gas to the asphalt surface, wherein the means for directing the flow of heated inert gas to the asphalt surface is a lance.

Preferably, the inert gas is nitrogen.

Advantageously, the source of a flow of inert gas is selected from the group consisting of a pressure swing adsorption nitrogen generator and compressed gas, preferably wherein the compressed gas is nitrogen.

Preferably, the system further comprises an air compressor for supplying air to the pressure swing adsorption nitrogen generator.

Conveniently, the pressure swing adsorption nitrogen generator is configured to provide a flow of nitrogen and a separate flow of oxygen within the system.

Advantageously, the system further comprises a burner or an electrical heater for supplying energy to the heater.

Preferably, the system further comprises means to supply the flow of oxygen to the burner.

Conveniently, the heater is configured to heat the inert gas flow to a temperature of from about 40° C. to about 650° C., for example from about 100° C. to about 500° C., such as from about 200° C. to about 450° C., for example from about 300° C. to about 400° C. and preferably of about 400° C.

According to another aspect of the invention, there is provided the use of a system as detailed above in repairing a defect in an asphalt surface.

According to an additional aspect of the invention, there is provided the use of a system as detailed above in removing indicia from an asphalt surface.

According to a further aspect of the invention, there is provided a method for repairing a defect in an asphalt surface, wherein the method comprises the steps of:

providing a flow of inert gas;

heating the flow of inert gas;

heating the asphalt surface using the flow of heated inert gas; and providing a filler material to the defect in the road surface, wherein the asphalt surface is heated using a lance.

Preferably, the inert gas is nitrogen.

Advantageously, the asphalt surface is heated to a temperature of greater than about 40° C., for example to temperatures between about 80° C. to about 400° C., such as between about 100° C. and about 200° C., preferably the asphalt surface is heated to temperatures of between about 100° C. and about 150° C.

Preferably, the method comprises the use of a pressure swing adsorption nitrogen generator or compressed nitrogen to provide the flow of nitrogen.

Conveniently, the pressure swing adsorption generator also provides a flow of oxygen.

Advantageously, the flow of inert gas is heated by the use of a burner or an electrical heater.

Preferably, the flow of oxygen is supplied to the burner.

Conveniently, the inert gas is heated to a temperature of from about 40° C. to about 650° C., for example from about 100° C. to about 500° C., such as from about 200° C. to about 450° C., for example from about 300° C. to about 400° C. and preferably to about 400° C.

Advantageously, the filler material is an asphalt, bituminous or aggregate material.

Preferably, the filler material is mechanically agitated.

The present invention will now be described, by way of example, with reference to the accompanying figures, in which.

Figure 3A:
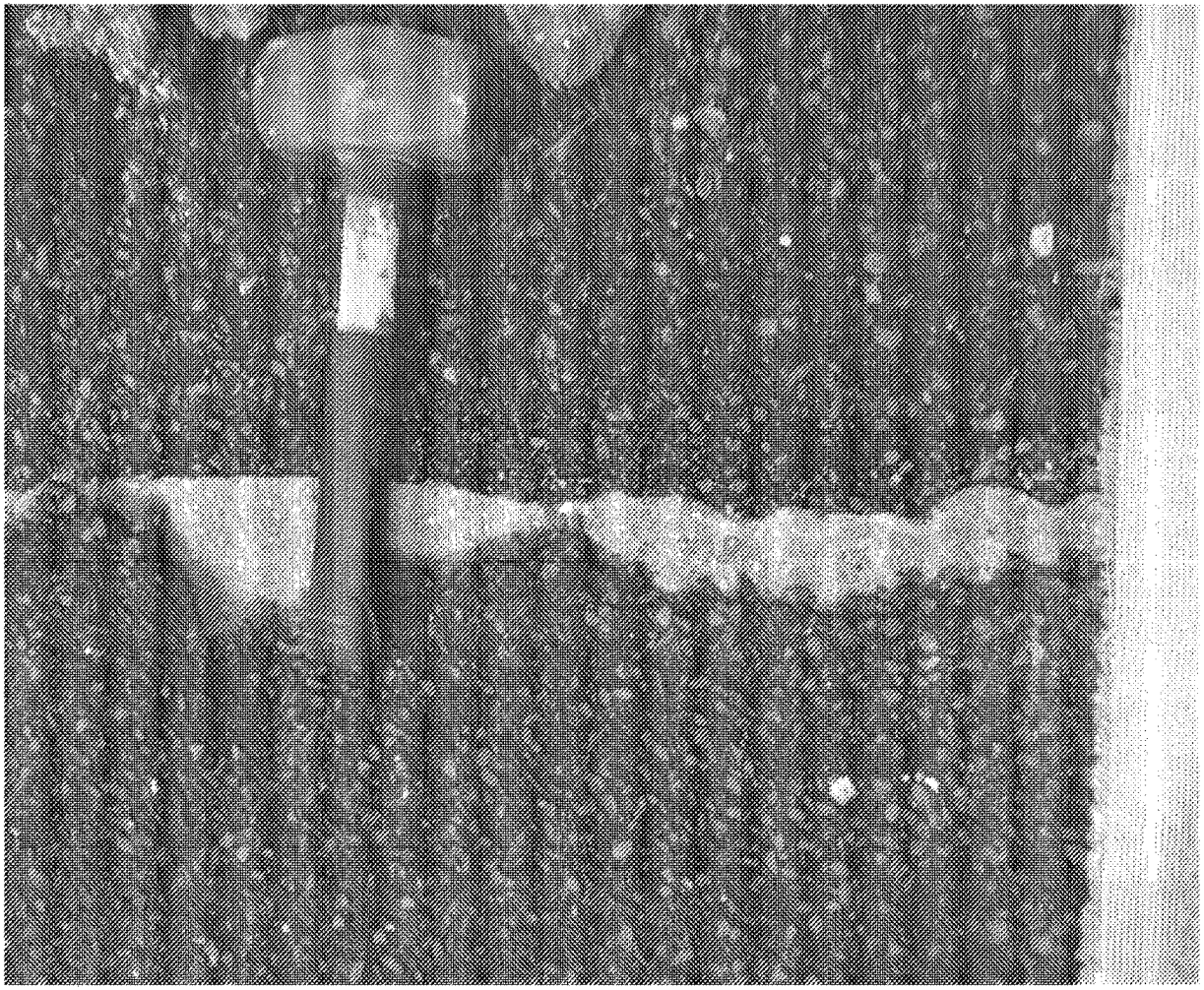
Figure 3B:
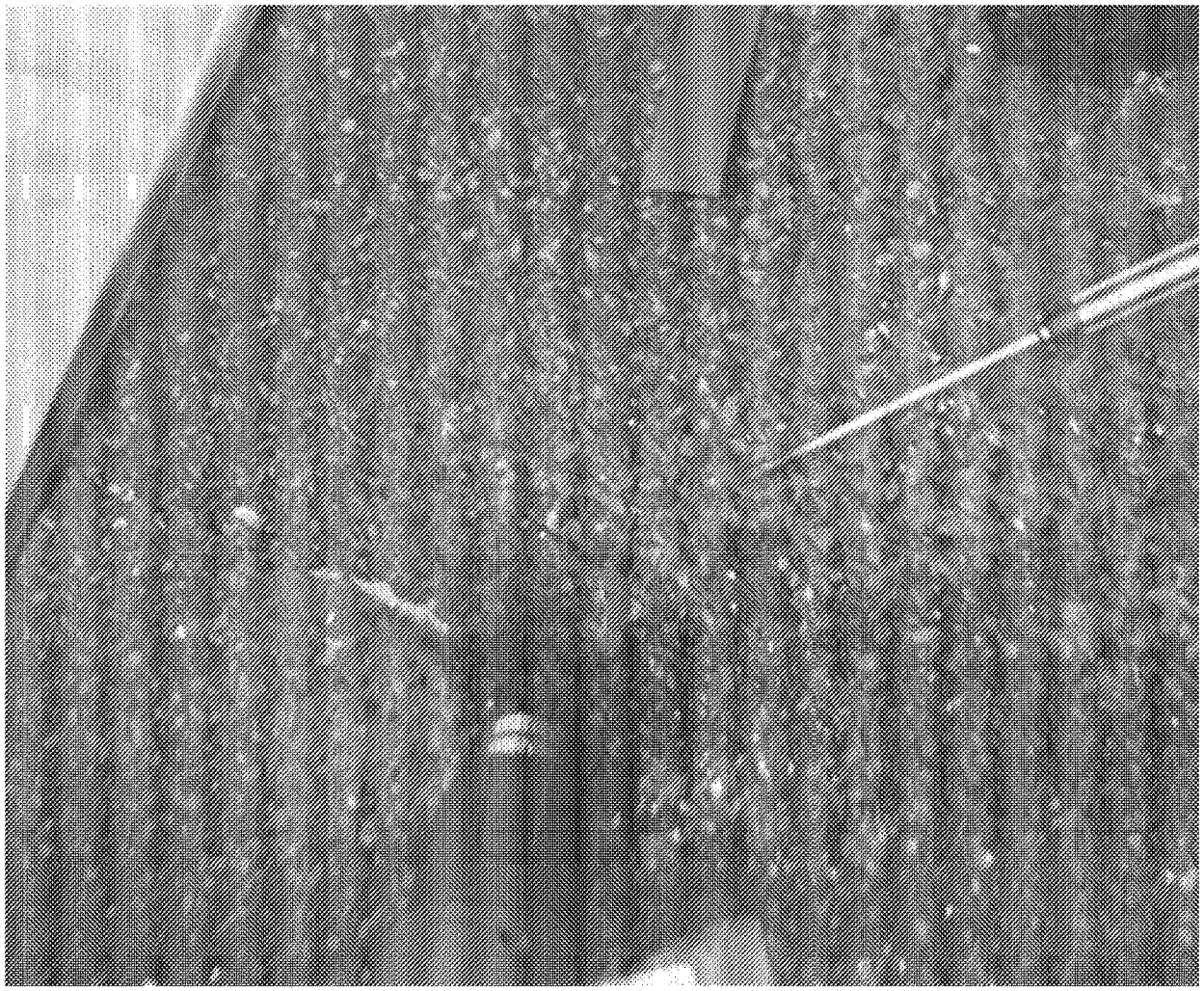
Figure 3C:
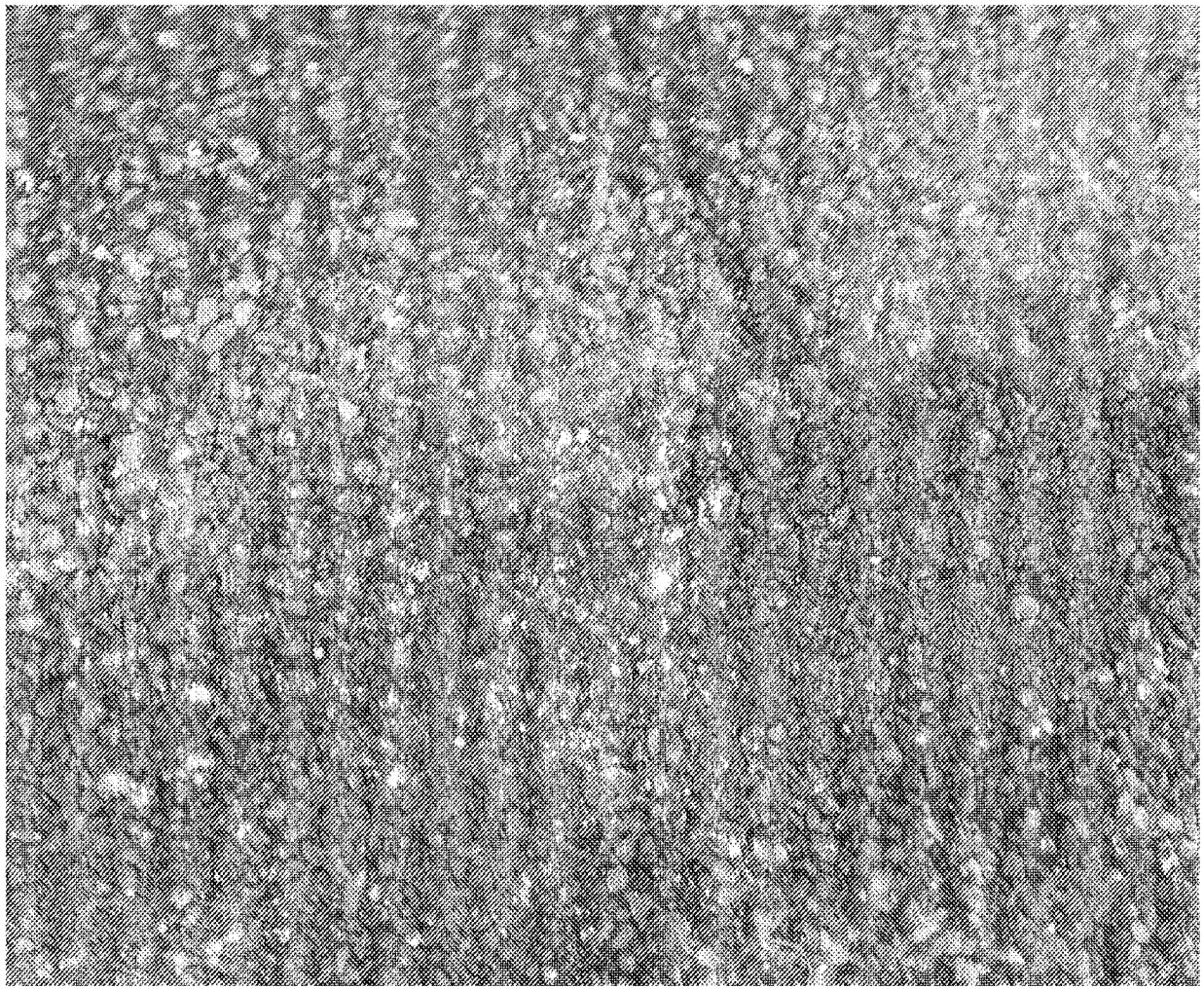

FIGS. 3A, 3B, and 3C depict a series of photographs of an area of an asphalt surface comprising a defect before (FIG. 3A), during (FIG. 3B), and after (FIG. 3C) repair using a system and method of the present invention.

Figure 4A:
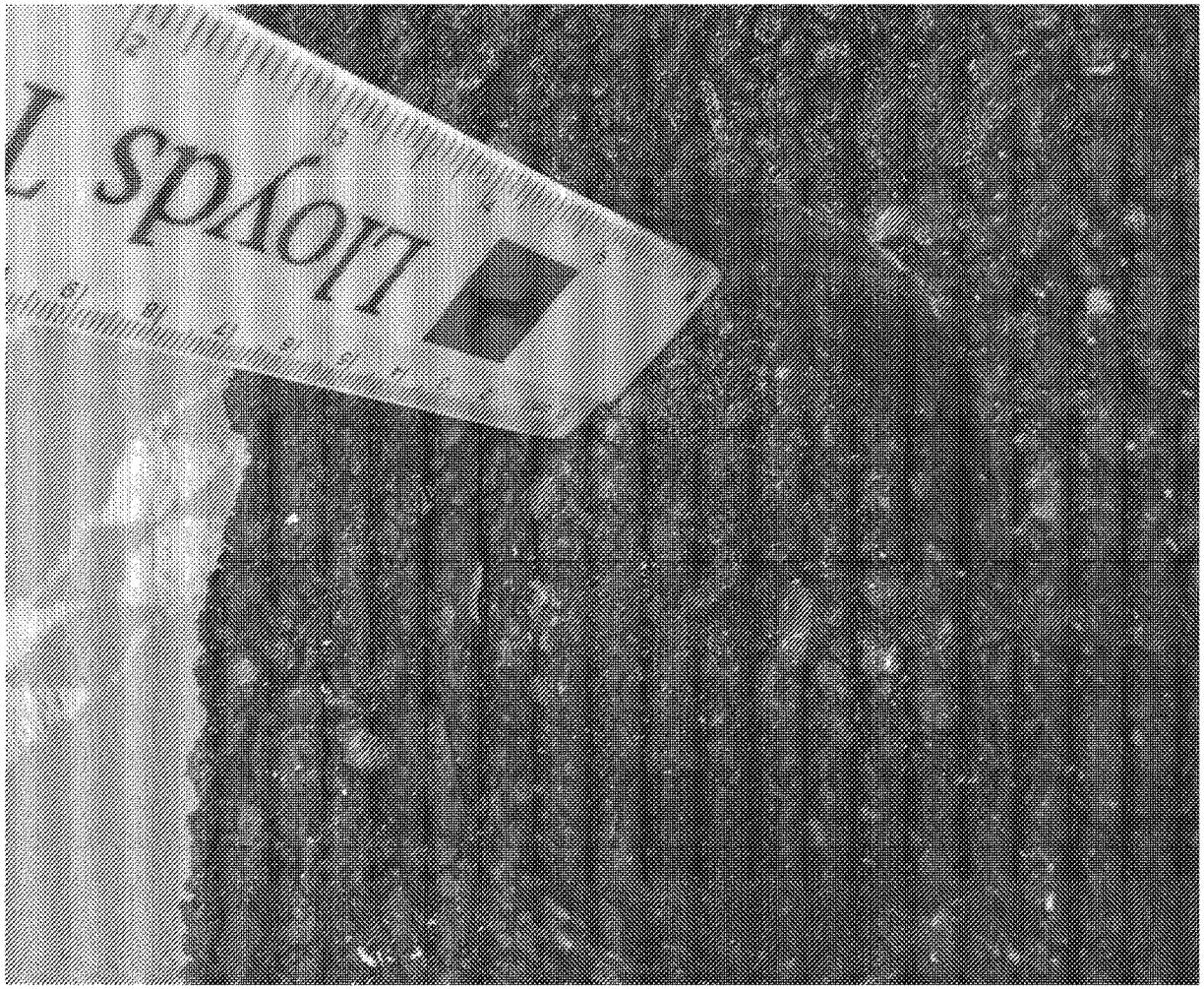
Figure 4B:
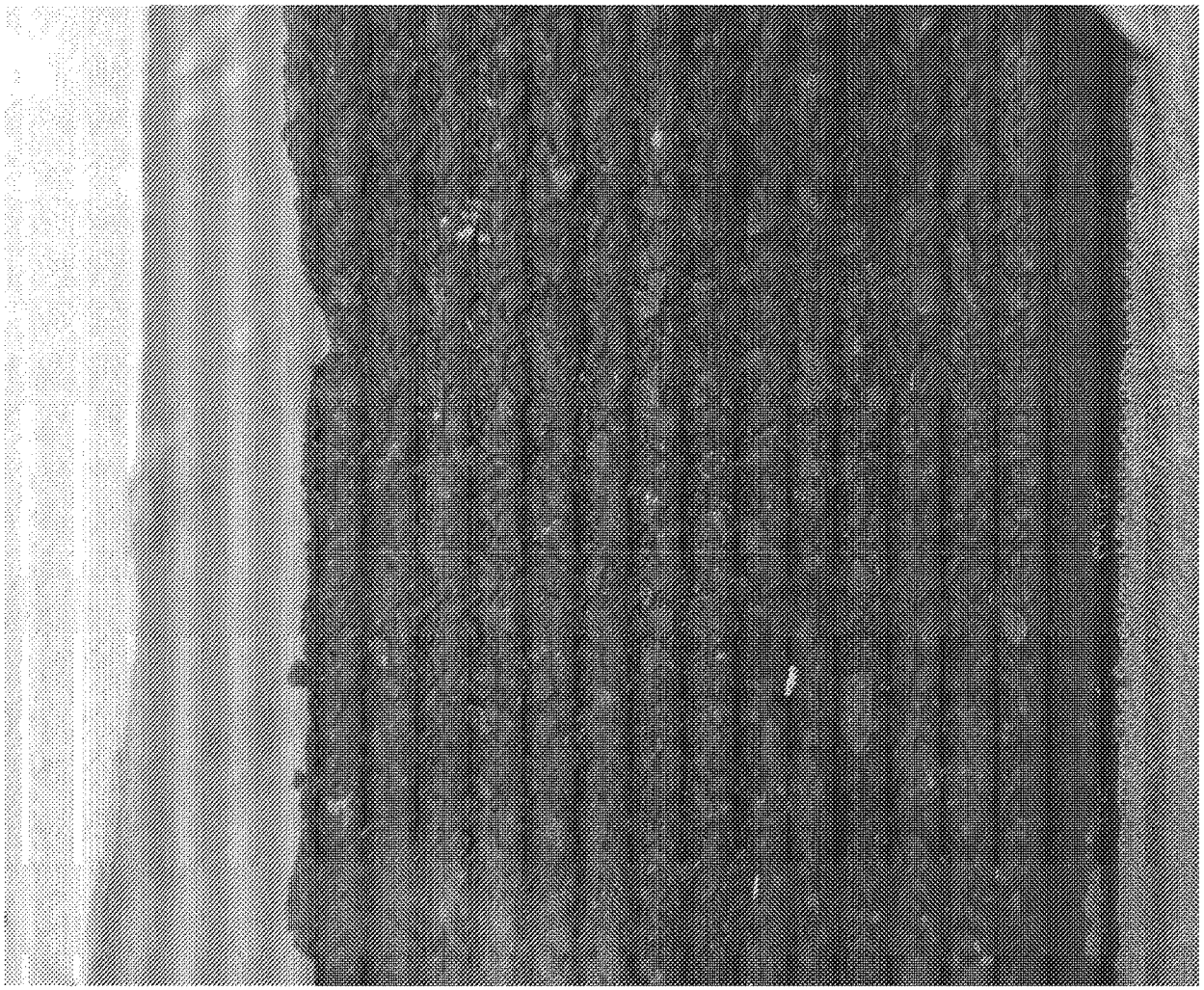

FIGS. 4A and 4B depict two images of an area of asphalt, wherein in the first image (FIG. 4A), the surface comprises a pothole and the second image (FIG. 4B), is the same area having been repaired using a system and method of the present invention.

Figure 5A:
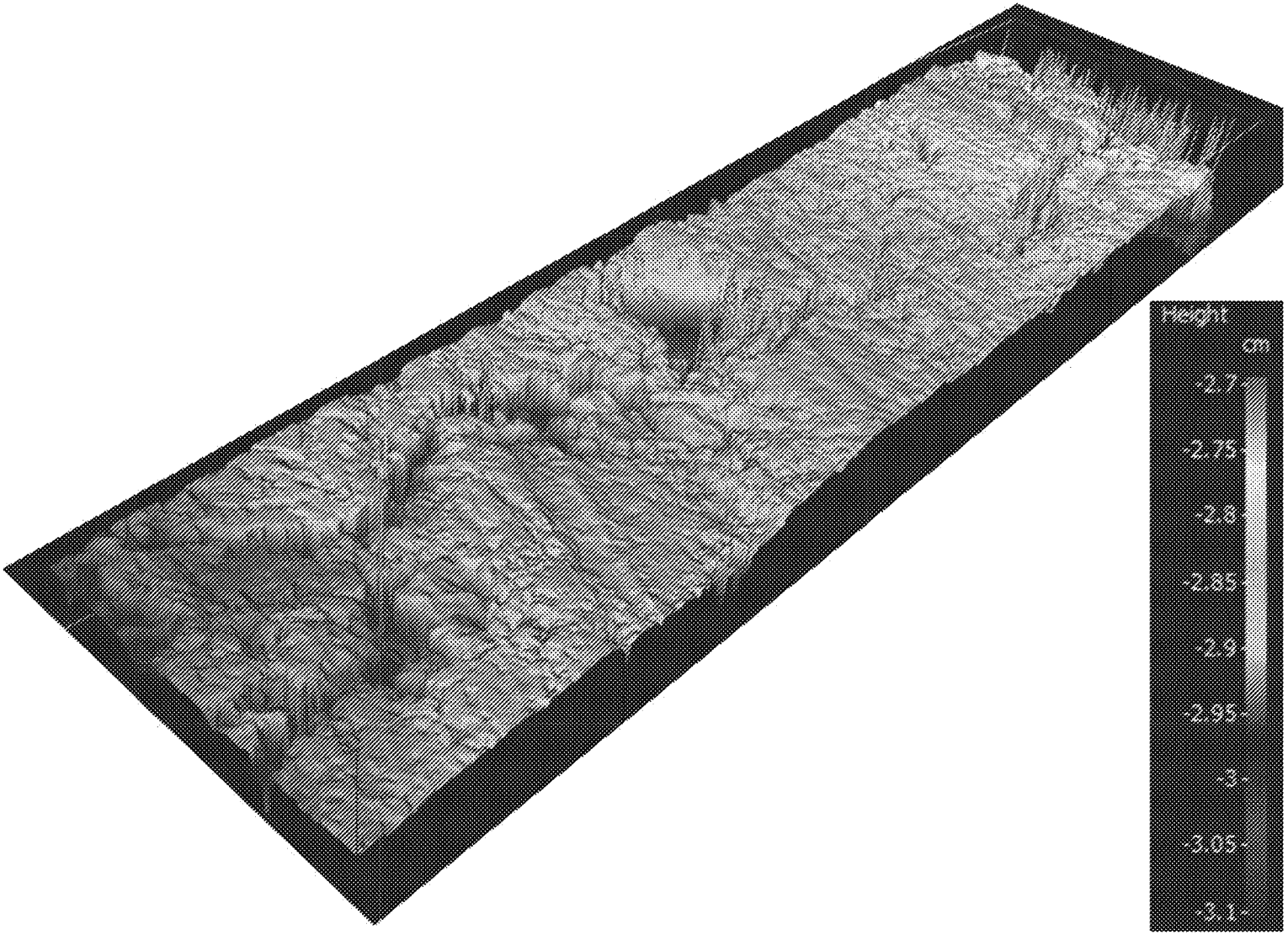
Figure 5B:
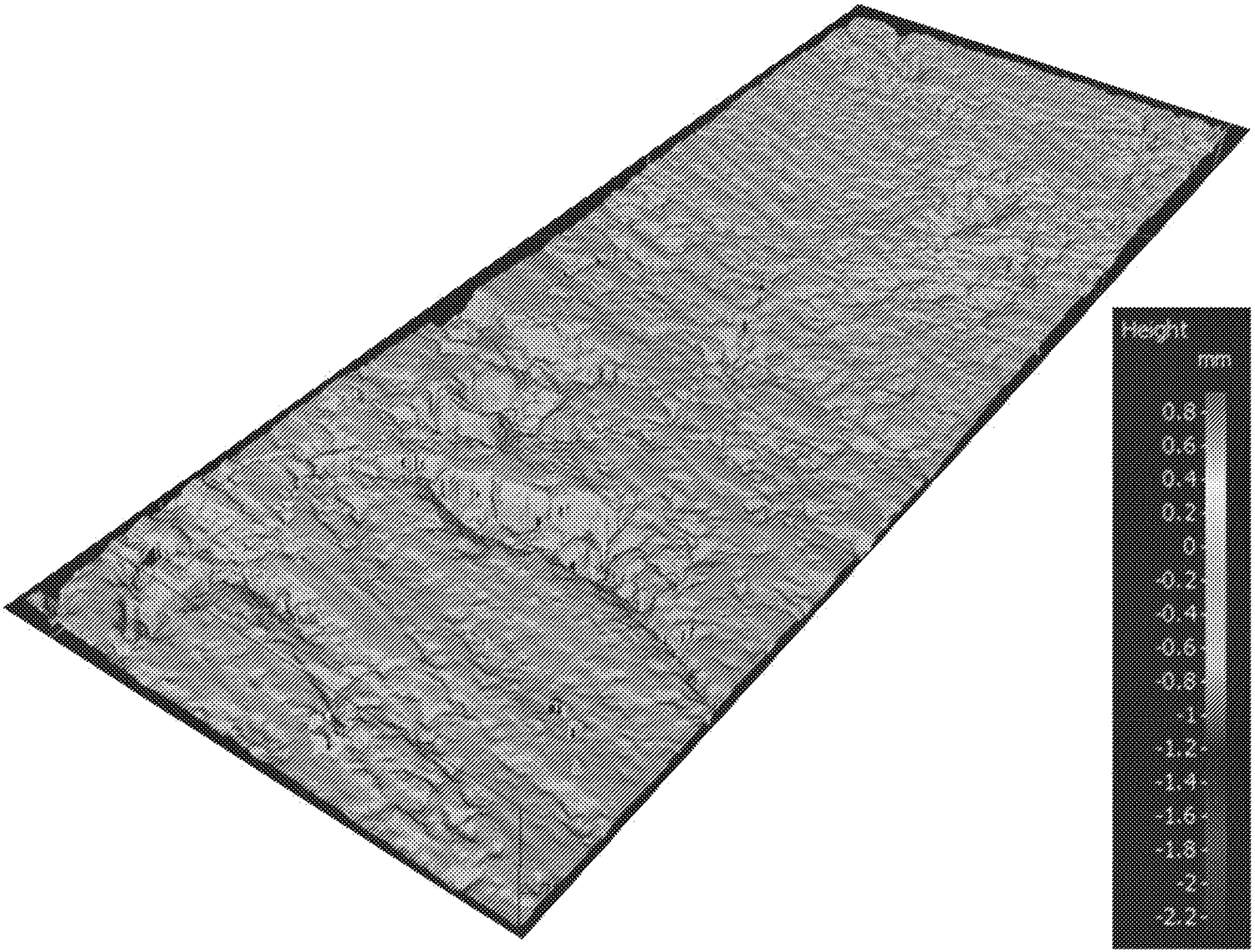

FIGS. 5A and 5B depict two surface profilometry images of an area of repaired asphalt, wherein FIG. 5A is of an area of asphalt repaired using a conventional system and FIG. 5A is of an area of asphalt repaired using the system of the invention.

DESCRIPTION OF INVENTION

A system and method is described for repairing a defect in an asphalt surface. The system comprises a source of a flow of inert gas, a heater for heating the flow of inert gas and means for directing the flow of heated inert gas to the asphalt surface.

The term "asphalt surface" herein is used to describe any surface that comprises an asphalt or bituminous component. Such surfaces include, but are not limited to, roads, pavements/sidewalks, runways, railway beds, cycle paths, flooring and tennis courts. Advantageously, the system of the invention is ideal for repairing a defect in the asphalt of a road surface. Furthermore, the term "asphalt surface" also includes any surface that comprises an asphalt or bituminous component adjoining a dissimilar surface, for example asphalt surfaces surrounding man-hole covers and drains. Indeed, the system of the invention is ideal for use in repairing asphalt surfaces adjoining dissimilar surfaces since the use of a lance allows fine control in directing the flow of heated inert gas.

The term "inert gas" herein is used to describe any gas that is essentially unreactive under the conditions present within the system and the method of the invention such as, for example, nitrogen, carbon dioxide, helium, neon, argon, krypton, xenon and radon. Preferably, the inert gas is nitrogen.

The term "defect" herein is used to describe any damaged portion of an asphalt surface and may include, for example, potholes, surface erosion and cracking, such as crocodile cracking or fatigue cracking.

In an embodiment, the system is mounted on a vehicle, such as a tractor, backhoe or a wheeled or skid-steer loader.

The source of the inert gas flow may be any suitable source, such as, for example, a compressed gas cylinder or liquefied gas. Preferably, the source of the inert gas flow is a pressure swing adsorption nitrogen generator.

Pressure swing adsorption systems operate on the principle of selective gas permeation, wherein a series of membrane systems within the generator produce nitrogen with a purity of typically greater than, or equal to, 95% from a source of atmospheric air. Preferably, the pressure swing adsorption nitrogen generator is supplied with air via the use of an air compressor. However, other sources of air, such as compressed air cylinders, may be used in the system.

In an embodiment, the flow of inert gas has a purity of greater than, or equal to, about 95 vol. %, such as greater than about 96, 97 or 98 vol. %, preferably the flow of inert gas has a purity of greater than, or equal to, about 99 vol. %, i.e., in other words, this percentage of the flow of gas is inert.

Conveniently, the flow of inert gas contains less than, or equal to, about 10 vol. % oxygen, such as less than about 9, 8, 7, 6, 5, 4, 3, or 2 vol. % oxygen, preferably the flow of inert gas contains less than, or equal to, about 1 vol. % oxygen.

In another embodiment, in addition to the flow of nitrogen-rich gas, the pressure swing adsorption nitrogen generator is also configured to provide a flow of oxygen-rich gas.

In a further embodiment, the flow of inert gas is supplied to a heater, wherein the gas is heated to temperatures of from about 40° C. to about 650° C. Advantageously, the inert gas is heated to a temperature of from about 100° C. to about 500° C., such as from about 200° C. to about 450° C., for example from about 300° C. to about 400° C., preferably the inert gas is heated to a temperature of about 400° C.

The energy for the heater may be supplied by a suitable burner, which burns a combustible fuel in the presence of oxygen. Such combustible fuels include, but are not limited to, petroleum fuels, natural gas, liquefied petroleum gas, biodiesel and alcohols. Preferably, the combustible fuel is natural gas.

In an embodiment, the flow of oxygen-rich gas leaving the pressure swing adsorption generator may be supplied to the burner and mixed with the combustible fuel in order to enhance combustion of the fuel. Optionally, the oxygen-rich gas may be mixed with air from a separate intake in order to regulate the oxygen levels of the oxygen-rich flow entering the burner.

In an alternative embodiment, the energy for the heater may be supplied by an electrical generator. Such a generator may be powered by diesel, preferably, the generator is powered by bio-diesel. By powering the generator with bio-diesel, the use of the system of the invention may be rendered carbon neutral or, preferably, carbon negative.

In embodiments where the system does not comprise a burner, the oxygen-rich flow is a by-product of the nitrogen adsorption generator. As such, the oxygen-rich flow may be stored and used for alternative purposes or released to the atmosphere.

Advantageously, after being heated, the flow of inert gas is supplied to the lance, which is used for directing the flow of heated inert gas to the asphalt surface. Preferably, the lance is a nitrogen lance.

The term "lance" refers to any apparatus that is configured to direct a high volume flow of gas to a surface. In this regard, the lance of the present invention is capable to direct a high volume flow of an inert gas from the system of the invention to an asphalt surface comprising a defect.

Typically, the inert gas has a flow rate of between about 100 to about 600 $Lmin^{-1}$, when it exits the lance, for example between about 100 to about 300 $Lmin^{-1}$, such as between about 100 to about 250 $Lmin^{-1}$, for example between about 150 to about 200 $Lmin^{-1}$, preferably the flow rate is 190 $Lmin^{-1}$.

In order to provide an inert gas flow rate within these ranges, it is advantageous for the inert gas to be at elevated pressures within the system. In an embodiment, the inert gas is at a pressure within the system of from about 1 to about 10 bar (about 100 to about 1000 kPa), for example from about 2 to about 10 bar (about 200 to about 1000 kPa), such as between about 4 to about 8 bar (about 400 to about 800 kPa), such as between about 5 to about 7 bar (about 500 to about 700 kPa), preferably the pressure of the inert gas within the system is about 6 bar (about 600 kPa).

The system of the invention is ideal for use in a method for repairing a defect in an asphalt surface. Such a method comprises the steps of:

providing a flow of inert gas;

heating the flow of inert gas;

heating the asphalt surface using the flow of heated inert gas; and providing a filler material to the defect in the road surface, wherein the asphalt surface is heated using a lance.

In an embodiment, the heating of the asphalt surface occurs before the provision of the filler material.

In another embodiment, the heating of the asphalt occurs after the provision of the filler material.

The provision and heating of the flow of inert gas is carried out as described above. Upon exiting the lance the asphalt surface is heated.

In an embodiment of the method of the invention, the asphalt surface is heated to temperatures of greater than, or equal to, 40° C. Advantageously, the asphalt surface is heated to temperatures between about 80° C. and about 400° C., such as between about 100° C. and about 200° C., preferably the asphalt surface is heated to temperatures of between about 100° C. and about 150° C.

At such temperatures the asphalt surface softens. Due to the presence of a substantially non-oxidising atmosphere surrounding the asphalt surface during heating, little to no oxidation of the asphalt takes place.

In using such a system, the asphalt surface may be heated to a higher temperature, and for longer if necessary, than conventional systems with little to no detrimental oxidation or degradation of the asphalt taking place.

In an embodiment, the asphalt surface is heated to a depth of up to at least about 40 mm, such as up to at least about 50 mm, for example up to about 70 mm, 80 mm, 90 mm or 100 mm. In some embodiments the asphalt surface is heated up to depths of greater than about 100 mm.

In an embodiment, upon heating the asphalt surface until it softens, the filler material may be mechanically agitated so as to mix the old asphalt surface and the new asphalt filler material together. The resulting effect is that a substantially homogenous mixture is created between the old asphalt and the new asphalt. Upon cooling of the asphalt surface, this results in a predominantly seamless repair to the road surface due to the homogenous bond between the old asphalt and the new asphalt. Therefore, the lifetime of the repaired defect is greatly improved due to the absence of a substantially weak seam between the old asphalt and the new asphalt.

The area of asphalt surface to be repaired may be heated for up to about 10 minutes, such as up to about 9, 8, 7 or 6 minutes. Preferably, the asphalt surface is heated for about 5 minutes. In this embodiment, the asphalt filler is typically preheated before adding to the defect. Preferably, the asphalt filler is preheated to a temperature between about 40° C. to about 150° C.

In another embodiment, the system of the invention may comprise a hot box configured to store the asphalt filler. Preferably, the hot box is connected to the source of flow of inert gas so as to heat the asphalt filler under an inert atmosphere prior to adding to the defect to be repaired.

Alternatively, the asphalt filler may be added cold, i.e. at room temperature, and heated once placed in the defect. In this embodiment the asphalt surface is typically heated by the hot flow of inert gas for longer than if the asphalt filler was added hot. For example, the asphalt surface may be heated for up to about 10 minutes, for example, for up to about 9, 8, 7 or 6 minutes. Preferably, in this embodiment, the asphalt surface is heated for about 6 minutes.

After its addition to the defect, the asphalt filler is mechanically agitated in order to provide a substantially homogenous mix of the old asphalt and the new asphalt. This mixing may take place over a time scale of up to about 10 minutes, such as up to about 9, 8, 7 or 6 minutes. Preferably, the surface is mechanically agitated for about 5 minutes.

Preferably, the asphalt surface is mechanically agitated whilst heating the surface. In an alternative embodiment, the heating of the surface may be stopped whilst the mechanical agitation takes place.

The agitation of the asphalt filler may be carried out using any suitable tool, such as pick, shovel, rake, whacker plates or rollers.

By using the system and/or method of the invention, the repairing of the asphalt surface typically takes no longer than about 1 hour depending on the surface area of the defect to be repaired. Ideally, the defect takes no longer than about 30 minutes to be repaired.

Due to the limited amount of oxidation of the asphalt surface during heating when compared with other systems, the resulting surface is much less brittle than asphalt surfaces repaired using conventional systems.

Tests have been performed to monitor the carbon monoxide (CO) and carbon dioxide ($CO_2$) levels in the atmosphere above an area of asphalt surface that is being repaired using a system and method according to the present invention.

CO and $CO_2$ levels were monitored at a height of 15 cm above the surface of the asphalt area being repaired (i.e. at a height above the surface where the inert gas flow begins to mix with atmospheric air). CO levels of no more than about 1 ppm were detected and $CO_2$ levels of around about 380 to about 400 ppm were detected. In essence, the levels of $CO_2$ and CO in the atmosphere above the asphalt surface were negligible.

These CO and $CO_2$ levels are within the range of normal background concentrations of CO and $CO_2$ in atmospheric air. From these results, it may be deduced that the use of the system and method of the present invention results in little to no oxidation and burning of the asphalt surface being repaired.

Overall, the result of using the system or method of the present invention is an asphalt defect repair which has a much extended lifetime when compared to repairs using currently known systems or methods. It is estimated that repairs to asphalt surfaces using the system or method of the present invention will have a lifetime of at least 5 years.

In another aspect, the system of the invention may be used to heat an asphalt surface comprising indicia, such as painted road markings, in order to heat the surface and remove the indicia. As well as not burning the surface of the asphalt using such a system, the indicia, such as road markings, themselves will not be burnt under the inert atmosphere, which leads to a lower amount of toxic fumes being produced when compared to a normal system used to remove markings.

Figure 1:
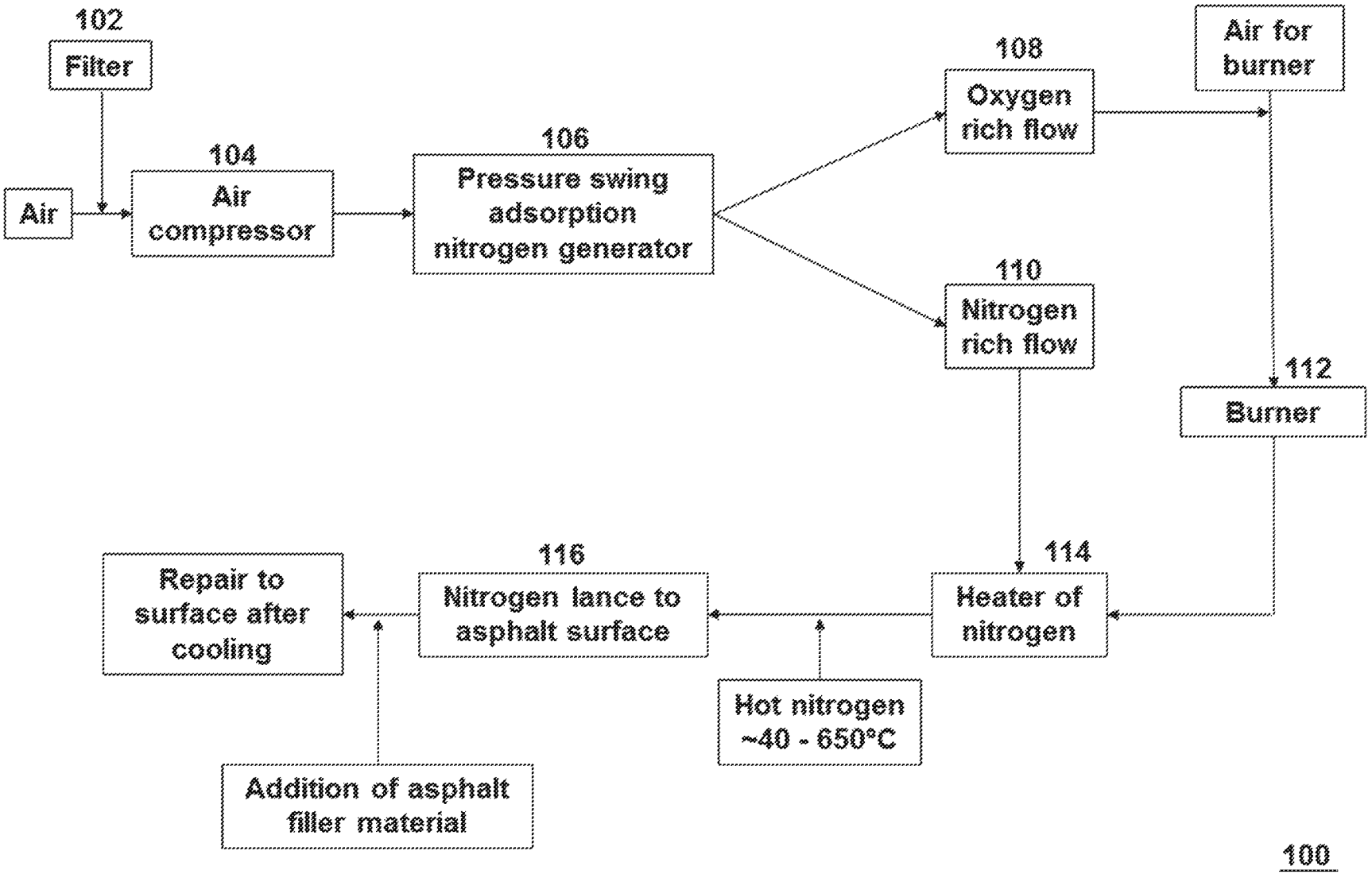
FIG. 1 is a schematic view of an asphalt heater system of the invention.

FIG. 1 is a schematic view of an exemplary system (100) of the present invention. The system comprises an air compressor (104) into which air is supplied through a filter (102). The air may be supplied from a compressed gas cylinder or may be supplied from the natural surrounding atmosphere.

The compressed air is supplied to a pressure swing adsorption nitrogen generator (106), wherein the air is separated into two gaseous flows, being an oxygen-rich gaseous flow (108) and a nitrogen-rich gaseous flow (110). Preferably, the purity of the nitrogen-rich gaseous flow is ≥99 vol. %.

The oxygen-rich gaseous flow is mixed with air from a separate intake in order to regulate the oxygen content of the gaseous flow. The oxygen gaseous flow is then supplied to a burner (112), which supplies energy to a heater (114).

The nitrogen-rich gaseous flow is supplied to the heater and is heated to a temperature of from about 40° C. to about 650° C. The hot nitrogen flow then passes through a nitrogen lance (116) and exits the lance at a rate of about 190 $Lmin^{-1}$.

Figure 2:
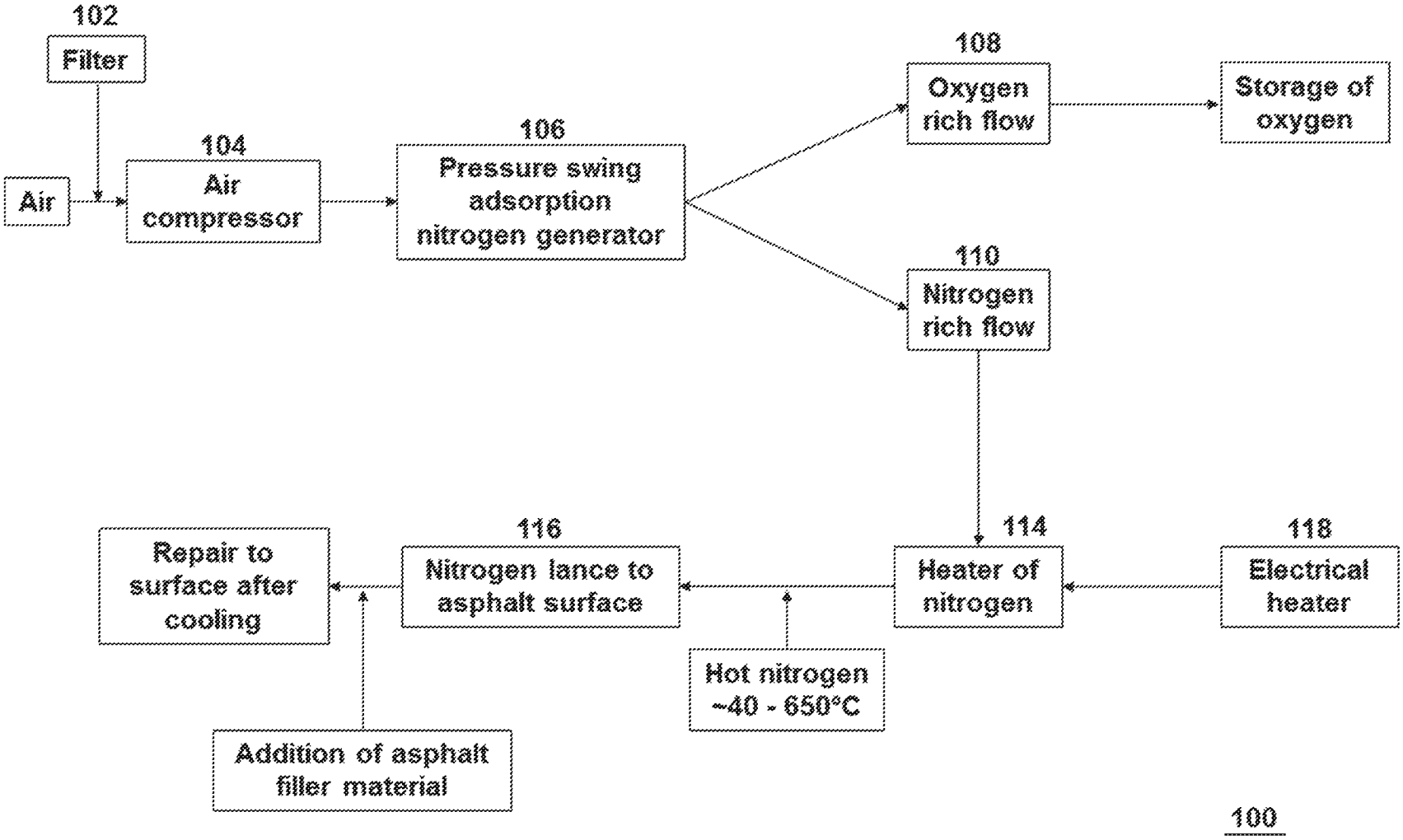
FIG. 2 is a schematic view of an alternative asphalt heater system of the invention.

FIG. 2 is a schematic view of an alternative exemplary system of the present invention. In this schematic the burner (112) of the schematic of FIG. 1 has been replaced by an electrical heater (118). The electrical heater may be powered by a generator or diesel generator. Preferably, the electrical heater is powered by a generator that runs on bio-diesel. The use of bio-diesel for powering the motor renders the system more environmentally friendly than currently used systems which are powered by generators that run on fossil fuels.

In either of the two systems detailed in FIGS. 1 and 2, after heating, the hot nitrogen gaseous flow is directed to an asphalt surface in need of repair in order to heat the asphalt surface. Wherein the asphalt surface is heated to a temperature of between about 130° C. to about 150° C. for up to about 5 minutes, An asphalt filler material preheated to a temperature of between about 130° C. to about 150° C. is then supplied to the defect.

After addition, the asphalt filler is mechanically agitated in order to provide a substantially homogenous mix of the old asphalt and the new asphalt. Preferably, this mechanical agitation lasts for a period of around 5 minutes. The agitation of the asphalt filler may be carried out using any suitable tool, such as a pick, shovel, rake whacker plates and rollers.

This method usual takes around 30 minutes to repair the asphalt surface, after which, the surface may be used as normal.

Upon cooling, the result is a surface comprising a substantially seamless repair between the old asphalt and the new asphalt added to repair the defect, wherein little to no oxidation of the asphalt surface takes place during the heating process.

FIGS. 3A through 3B show three images of an area of asphalt surface comprising a defect wherein the three images are taken, respectively, before, during and after repair of the defect using a system and method of the present invention.

The third image of this figure (FIG. 3C) shows that after cooling the area of asphalt that has undergone reparation, there is an essentially seamless repair between the old asphalt and the new asphalt added to repair the defect.

FIGS. 4A through 4B show two images of an asphalt surface. In the first image (FIG. 4A), the asphalt surface comprises a pot-hole. The second image (FIG 4B) is of the same area having been repaired using a system and method of the present invention. There is no discernible seam between the old asphalt surface and the new filler material that has been provided to the defect area.

FIGS. 5A through 5B show two surface profilometry images of an area of repaired asphalt. The asphalt surface of the first image (a) has been repaired using a conventional asphalt repair system, whereas the asphalt surface of the second image (b) has been repaired using a system of the invention using a heated flow of inert gas. From these images it can be seen that the use of a system of the invention leads to a smoother surface with less defects when compared to the surface repaired using a conventional system, which comprises many voids and irregularities. These two surfaces were analysed using X-ray radiography which showed that the sample of asphalt repaired using the system of the invention comprised less voids than the asphalt surface using the conventional system.

Preferences and options for a given aspect, feature or parameter of the invention should, unless the context indicates otherwise, be regarded as having been disclosed in combination with any and all preferences and options for all other aspects, features and parameters of the invention.

We claim:

1. An asphalt heater system, comprising a source of a flow of inert gas, a heater for heating the flow of inert gas and means for directing the flow of heated inert gas to the asphalt surface, wherein the means for directing the flow of heated inert gas to the asphalt surface is a lance;

wherein, the heater is configured to heat the inert gas flow to a temperature of from about 40° C. to about 650° C. and to direct the heated inert gas at a flow rate of between 100 and 600 L/min when the heated inert gas exits the lance.

2. The system according to claim 1, wherein the inert gas is nitrogen.

3. The system according to claim 1, wherein the source of a flow of inert gas is selected from the group consisting of a pressure swing adsorption nitrogen generator and compressed gas.

4. The system according to claim 3, wherein the system further comprises an air compressor for supplying air to the pressure swing adsorption nitrogen generator.

5. The system according to claim 3, wherein the pressure swing adsorption nitrogen generator is configured to provide a flow of nitrogen and a separate flow of oxygen within the system.

6. The system according to claim 1, wherein the system further comprises a burner or an electrical generator for supplying energy to the heater.

7. The system according to claim 6, wherein the system further comprises means to supply the flow of oxygen to the burner.

8. The system according claim 1, wherein the heater is configured to heat the inert gas flow to a temperature of from about 100° C. to about 500° C.

9. Use of a system according to claim 1 in repairing a defect in an asphalt surface.

10. A method for repairing a defect in an asphalt surface, wherein the method comprises the steps of:

providing a flow of inert gas;

heating the flow of inert gas;

heating the asphalt surface using the flow of heated inert gas; and providing a filler material to the defect in the road surface, wherein the asphalt surface is heated using a lance;

wherein the inert gas is heated to a temperature of from about 40° C. to about 650° C.; and wherein the method further comprises a step of mechanically agitating the filler material so as to mix together the asphalt surface and the filler material.

11. The method according to claim 10, wherein the inert gas is nitrogen.

12. The method according to claim 10, wherein the asphalt surface is heated to a temperature between about 80° C. and about 400° C.

13. The method according to claim 11, comprising using a pressure swing adsorption nitrogen generator or compressed nitrogen to provide the flow of nitrogen.

14. The method according to claim 13, wherein the pressure swing adsorption generator also provides a flow of oxygen.

15. The method according to claim 10, wherein the flow of inert gas is heated by the use of a burner or an electrical heater.

16. The method according to claim 15, wherein the flow of oxygen is supplied to the burner or electrical heater.

17. The method according to claim 10, wherein the inert gas is heated to a temperature of from about 100° C. to about 500° C.

18. The method according to claim 10, wherein the filler material is an asphalt, bituminous or aggregate material.

19. The method according to claim 10, wherein the filler material is mechanically agitated.

* * * * *